US011111861B2

(12) United States Patent
Dlugi et al.

(10) Patent No.: US 11,111,861 B2
(45) Date of Patent: Sep. 7, 2021

(54) ENGINE SPEED CONTROL SYSTEM

(71) Applicant: Briggs & Stratton, LLC, Wauwatosa, WI (US)

(72) Inventors: Zach Dlugi, Wauwatosa, WI (US); Aaron Halfmann, West Bend, WI (US); Kyle Clasen, Hartland, WI (US); David Roth, Wauwatosa, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 0 days.

(21) Appl. No.: 15/910,850

(22) Filed: Mar. 2, 2018

(65) Prior Publication Data

US 2018/0252168 A1 Sep. 6, 2018

Related U.S. Application Data

(60) Provisional application No. 62/466,985, filed on Mar. 3, 2017.

(51) Int. Cl.

| | |
|---|---|
| ***F02D 9/10*** | (2006.01) |
| ***F02M 7/04*** | (2006.01) |
| ***F02D 9/02*** | (2006.01) |

(52) U.S. Cl.

CPC ..... *F02D 9/1065* (2013.01); *F02D 9/02* (2013.01); *F02D 9/107* (2013.01); *F02M 7/045* (2013.01); *F02D 2009/023* (2013.01); *F02D 2009/0213* (2013.01); *F02D 2009/0245* (2013.01)

(58) Field of Classification Search

CPC ..... F02D 9/10; F02D 9/107; F02D 9/1065; F02D 9/02

USPC ..... 123/336–339.1, 339.25, 339.28

See application file for complete search history.

(56) References Cited

U.S. PATENT DOCUMENTS

| | | | | |
|---|---|---|---|---|
| 3,305,223 | A * | 2/1967 | Reichenbach | F02M 1/02 261/52 |
| 3,577,806 | A * | 5/1971 | Schaefer | F16H 59/24 477/156 |
| 4,517,942 | A | 5/1985 | Pirkey et al. | |
| 5,048,478 | A | 9/1991 | Bonde et al. | |
| 5,163,401 | A | 11/1992 | Reese | |
| 5,720,250 | A | 2/1998 | Greppmair et al. | |
| 6,213,083 | B1 | 4/2001 | Winberg | |
| 6,932,055 | B2 | 8/2005 | Rado | |
| 7,118,097 | B2 * | 10/2006 | Moriyama | F02M 1/10 261/39.4 |
| 7,152,580 | B2 | 12/2006 | Wetor et al. | |
| 7,165,532 | B2 | 1/2007 | Steffes et al. | |
| 7,270,111 | B2 | 9/2007 | Grybush et al. | |

(Continued)

FOREIGN PATENT DOCUMENTS

EP 1 672 201 A1 6/2006

*Primary Examiner* — John Kwon
*Assistant Examiner* — Johnny H Hoang
(74) *Attorney, Agent, or Firm* — Foley & Lardner LLP

(57) ABSTRACT

Systems and apparatuses include an engine including a fuel tank, a carburetor including a throttle valve movable between a first throttle position and a second throttle position, a governor system configured to move the throttle valve, and a speed control system including a control lever defining a first actuation distance, and a bellcrank movable between an idle position and a high speed position and coupled to the governor system. The bellcrank defining a second actuation distance that is different than the first actuation distance.

20 Claims, 21 Drawing Sheets

(56) References Cited

U.S. PATENT DOCUMENTS

| | | | | |
|---|---|---|---|---|
| 8,408,183 | B2 * | 4/2013 | Johnson | F02D 11/02 123/198 D |
| 9,074,535 | B1 * | 7/2015 | Huibregtse | F02D 9/1065 |
| 2001/0008132 | A1 | 7/2001 | Ikeda | |
| 2007/0181100 | A1 * | 8/2007 | Grybush | F02D 11/04 123/400 |
| 2018/0252190 | A1 * | 9/2018 | Roth | F02M 37/007 |

* cited by examiner

ENGINE SPEED CONTROL SYSTEM

CROSS-REFERENCE TO RELATED PATENT APPLICATIONS

This application claims the benefit of and priority to U.S. Provisional Patent Application No. 62/466,985, filed Mar. 3, 2017. This application is related to U.S. Provisional Patent Application No. 62/466,257 filed on Mar. 2, 2017, and is also related to U.S. Design patent application Ser. No. 29/594,461 filed on Feb. 17, 2017. The entirety of each application listed in this paragraph is incorporated by reference herein.

BACKGROUND

The present application relates generally to speed control for engines. More specifically, the present application relates to a speed control system arrangeable in a variable speed mode or a fixed speed mode, and that can be used with more than one remote actuation system.

SUMMARY

One embodiment relates to an engine that includes a fuel tank, a carburetor including a throttle valve movable between a first throttle position and a second throttle position, a governor system configured to move the throttle valve, and a speed control system including a control lever defining a first actuation distance, and a bellcrank movable between an idle position and a high speed position and coupled to the governor system. The bellcrank defines a second actuation distance that is different than the first actuation distance.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the drawings, a speed control system for an engine is shown and described that includes a speed control lever and a bellcrank. The speed control lever and the bellcrank include multiple connection points allowing the speed control system to be controlled manually in a manual control mode, or remotely in a remote control mode. The connection points providing for remote operation can be arranged to operate with solid wire actuators or soft wire actuators. Additionally, the bellcrank is structured to operate with different actuation systems having different actuation travel distances. In one example, the bellcrank has connections providing for operation with a 15 millimeter or a 20 millimeter, or a 17.5 millimeter travel distance. The speed control system can be arranged to operate in a variable speed mode with the position of the speed control lever affecting the operational speed of the engine, or a fixed speed mode where the bellcrank is fixed. The speed control system can also include an ignition kill and a fuel shutoff that are actuated by the speed control lever. In some embodiments, actuation of the speed control lever, either manually or remotely, acts to affect the speed of the engine, the ignition kill, and the fuel shutoff.

Figure 1:
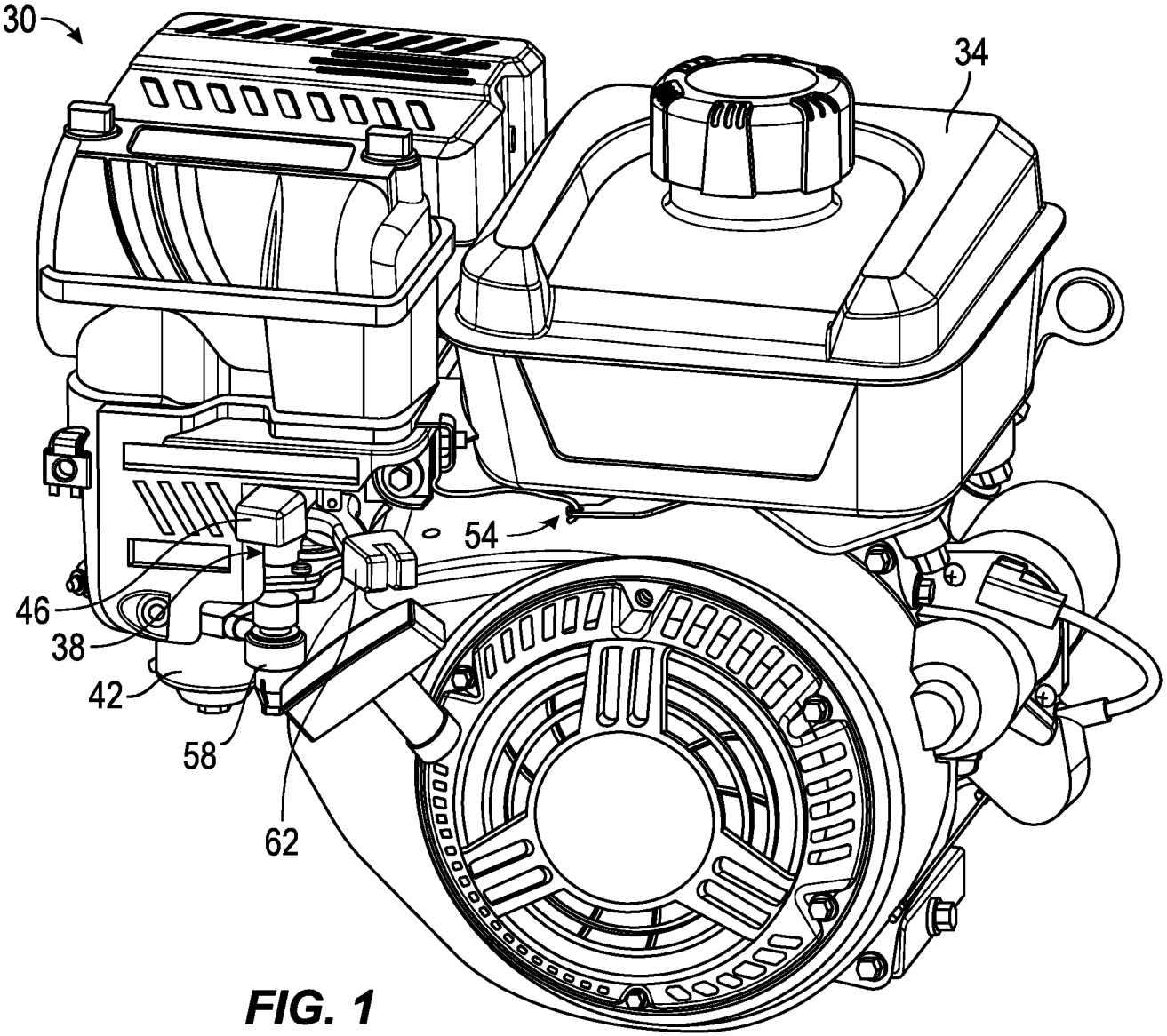
FIG. 1 is a pictorial view of an engine according to one embodiment.

As shown in FIG. 1, an engine 30 includes a fuel tank 34, and a speed control system 38 that includes a carburetor 42, a speed control lever 46, a bellcrank 50 (not visible in FIG. 1, see FIG. 4), a governor system 54, and a transport valve system 58. The engine 30 may be used to power outdoor power equipment, portable jobsite equipment, or other equipment that requires a prime mover. Outdoor power equipment may include lawn mowers, riding tractors, snow throwers, pressure washers, tillers, log splitters, zero-turn radius mowers, walk-behind mowers, riding mowers, stand-on mowers, pavement surface preparation devices, industrial vehicles such as forklifts, utility vehicles, commercial turf equipment such as blowers, vacuums, debris loaders, over-seeders, power rakes, aerators, sod cutters, brush mowers, portable generators, etc. Outdoor power equipment may, for example, use the engine 30 to drive an implement, such as a rotary blade of a lawn mower, a pump of a pressure washer, an auger of a snow thrower, and/or a drivetrain of the outdoor power equipment. Portable jobsite equipment may include portable light towers, mobile industrial heaters, and portable light stands.

The carburetor 42 includes a throttle valve that is moveable between a first position in the form of a low speed position and a second position in the form of a high speed position and thereby control the air fuel mixture exiting the carburetor 42 and entering a combustion chamber of the engine 30, and a choke lever 62 arranged to adjust the position of a choke valve to control air flow into the carburetor 42. The carburetor 42 is arranged to mix fuel from the fuel tank 34 with air and provide the mixture to the combustion chamber. In some embodiments, the choke lever 62 may be eliminated or arranged in a different position/location on the engine 30.

The engine 30 may be in the form of a small, single-cylinder, four-stroke cycle, internal combustion engine and includes an engine block, an air intake, and an exhaust. Interior to the engine 30, the engine 30 includes a passageway configured to channel air from the air intake to a combustion chamber. Along the passageway, fuel is mixed with the air in the carburetor 42 or other fuel injection device. Combustion in the combustion chamber converts chemical energy to mechanical energy (e.g., rotational motion, torque) via a piston, a connecting rod, and a crankshaft, which may then be coupled to one or more rotating tools (e.g., blade, alternator, auger, impeller, tines, drivetrain) of outdoor power equipment. In the illustrated embodiment, the crankshaft is a horizontal crankshaft arranged to provide power to an output shaft 66 (see FIG. 3) arranged to provide power to one or more implements. In other embodiments, the crankshaft is a vertical crankshaft. In other embodiments, the engine 30 includes two or more cylinders (e.g., two cylinders arranged in a V-twin configuration).

The bellcrank 50 is coupled to the carburetor 42 via the governor system 54, and the bellcrank 50 interacts with the governor system 54 to control the amount of fuel air mixture provided to the combustion chamber of the cylinder and thereby vary the operating speed of the engine 30. The transport valve system 58 is arranged in the fuel flow path between the fuel tank 34 and the carburetor 42 and operates in response to the speed control lever 46 to selectively inhibit fuel flow from the fuel tank 34 to the carburetor 42.

Figure 2:
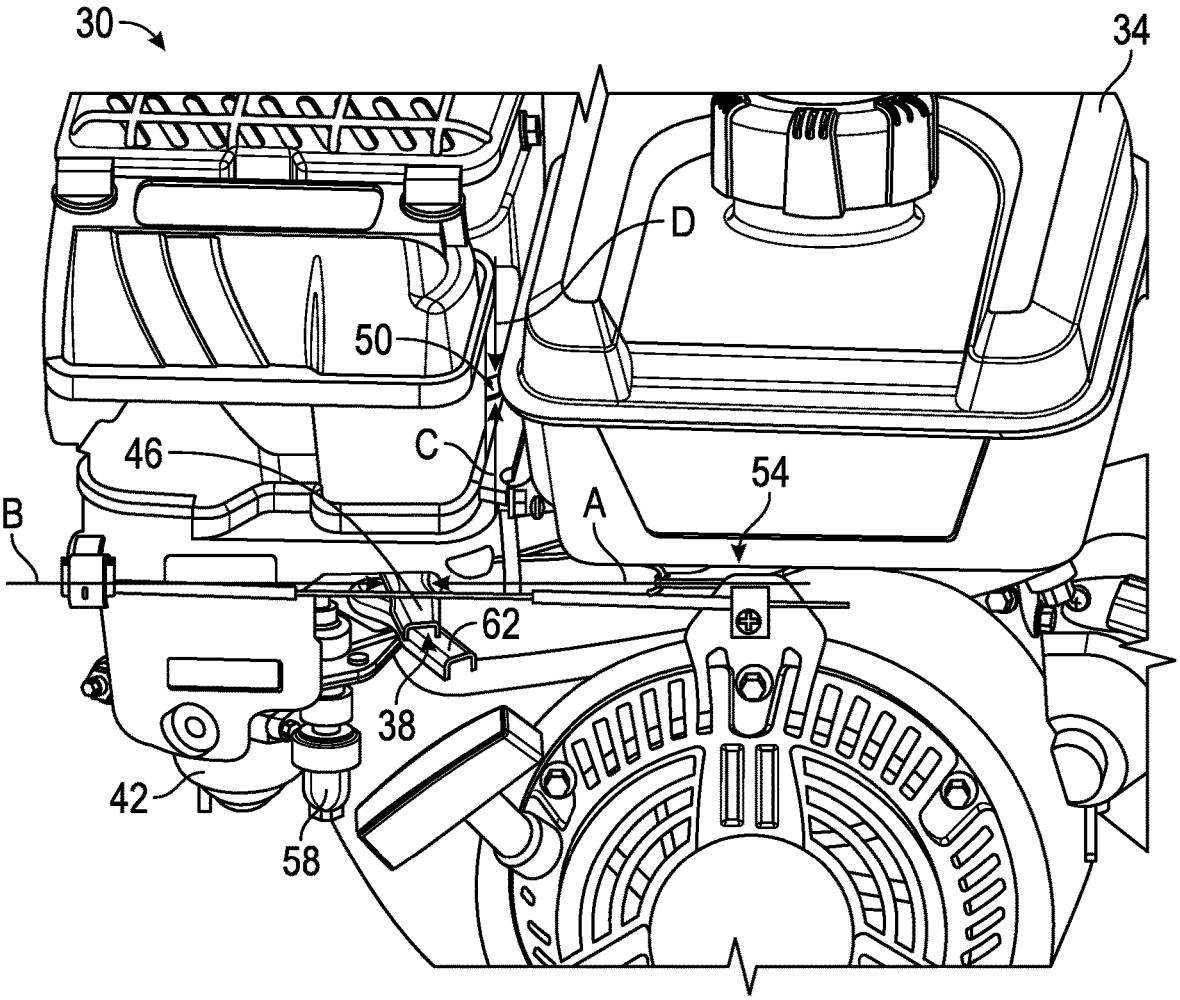
FIG. 2 is a pictorial view of the engine of FIG. 1 showing four speed control actuation directions.
Figure 3:
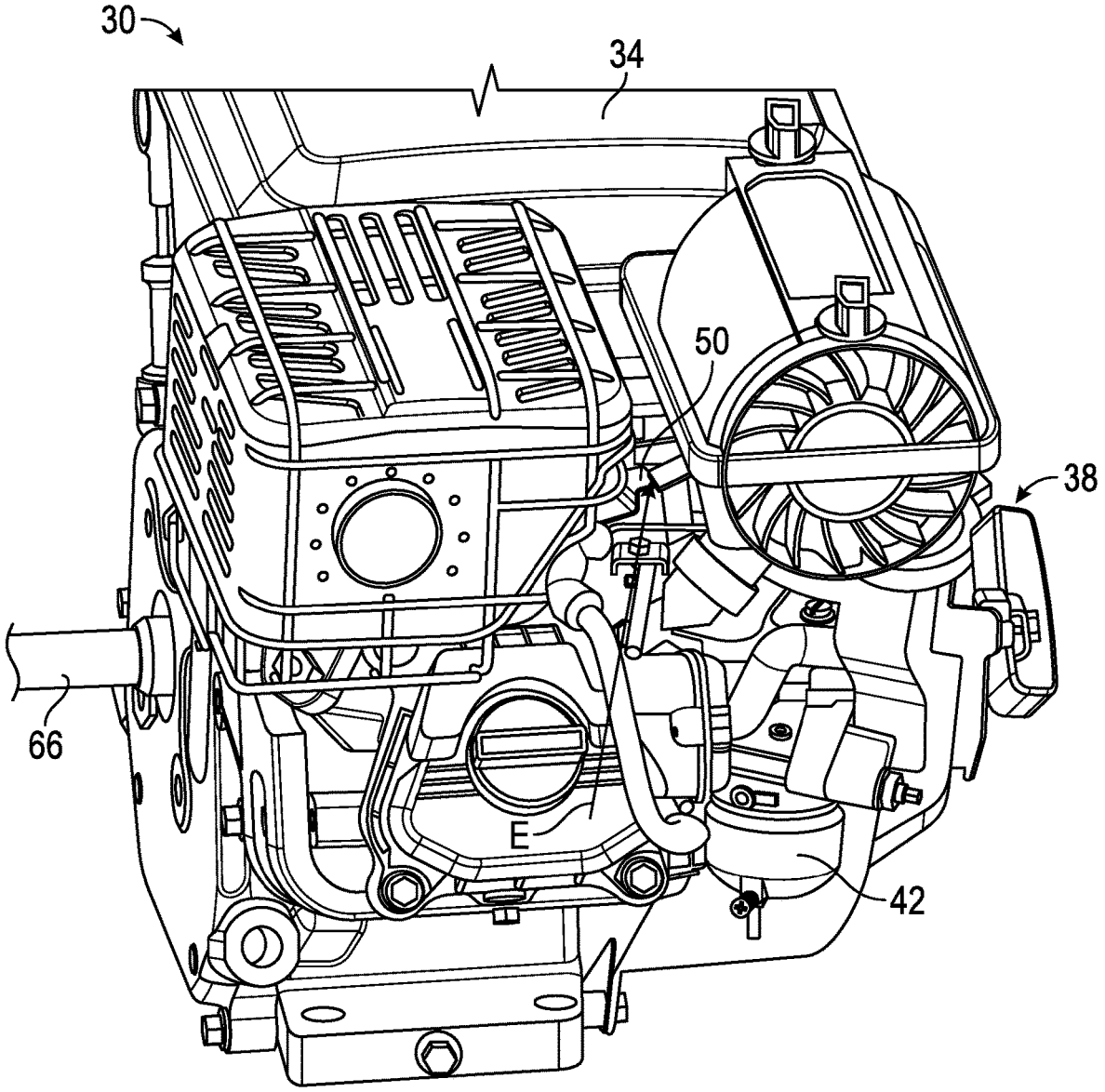
FIG. 3 is a pictorial view of the engine of FIG. 1 showing another speed control actuation direction.

As shown in FIGS. 2 and 3, the speed of the engine 30 can be controlled remotely from five different directions: a right lever direction A, a left lever direction B, a front bellcrank direction C, a back bellcrank direction D, and a left bellcrank direction E (see FIG. 3). The five directions A-E define actuation directions that may be used by remote actuators to control the speed control system 38. In some embodiments, the right lever direction A can be used with a solid wire actuator in a push to high speed no load (HSNL) arrangement. The left lever direction B can used with a solid wire actuator in a pull to HSNL arrangement. The front bellcrank direction C can be used with a solid wire actuator or a soft wire actuator in a pull to HSNL arrangement. The back bellcrank direction D can be used with a solid wire actuator in a push to HSNL arrangement. The left bellcrank direction E can be used with a solid wire actuator or a soft wire actuator in a pull to HSNL arrangement.

Figure 4:
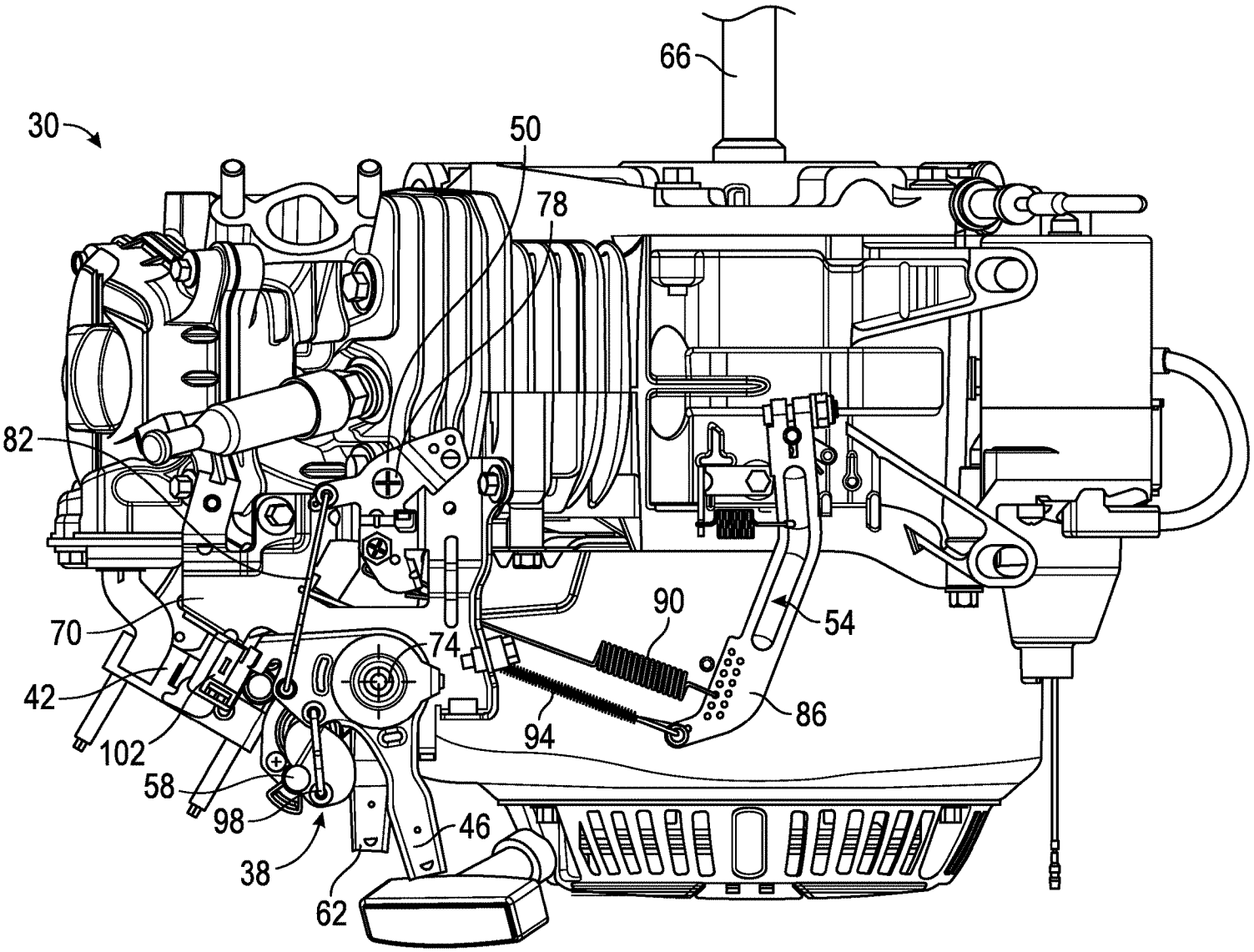
FIG. 4 is a top view of the engine of FIG. 1 showing a speed control system an off arrangement, according to one embodiment.

As shown in FIG. 4, the speed control lever 46 is rotatably mounted to a bracket 70 about a first axis 74 and the bellcrank 50 is rotatably mounted to the bracket about a second axis 78. The speed control lever 46 is connected to the bellcrank 50 with a control link 82 so that rotation of the speed control lever 46 about the first axis 74 results in rotation of the bellcrank 50 about the second axis 78.

As also shown in FIG. 4, the governor system 54 includes a governor arm 86 coupled to the bellcrank 50 by a governor spring 90 and controlled by a governor or speed sensing device in response to the speed of the engine 30, and a governor link 94 that is coupled to the throttle valve of the carburetor 42 to control the fuel air mixture provided to the combustion chamber of the engine 30. In some embodiments, moving the speed control lever 46 causes the rotation of the bellcrank 50 and changes the tension in the governor spring 90 which affects the speed of the engine 30 by changing the force balance in governor system 54, which moves the throttle valve via the governor arm 86 and governor link 94. In some embodiments, movement of the speed control lever 46 only affects the position of the throttle valve if the engine 30 is running. When the engine 30 is off, moving the speed control lever 46 has no effect on the position of the throttle valve as the throttle valve is held in the fully open state by a governor idle spring. The governor system 54 may also include weights, a slider cup, a crank, springs, links, and other components, as desired.

As also shown in FIG. 4, the transport valve system 58 includes a transport valve that is actuatable so that a valve element is moveable between an open position and a closed position to selectively inhibit fuel flow to the carburetor 42. The transport valve system 58 is controlled by the speed control lever 46. A transport link 98 is connected between the speed control lever 46 and the transport valve system 58. When the speed control lever 46 is arranged in an off position (as shown in FIG. 4), the transport link 98 actuates the transport valve system 58 to a transport position where fuel is inhibited from flowing to the carburetor 42. Embodiments of the transport valve system 58 are discussed in U.S. Provisional Patent Application No. 62/466,257 filed on Mar. 2, 2017 and incorporated by reference herein in its entirety.

As also shown in FIG. 4, an electrical shutoff element in the form of a ground switch 102 is mounted on the bracket 70 and positioned to interact with the speed control lever 46. When the speed control lever 46 is arranged in the off position (as shown in FIG. 4), the ground switch 102 grounds an ignition circuit of the engine 30 so that the engine 30 is inhibited from running. Further details and embodiments of the electrical shutoff element are discussed in U.S. Provisional Patent Application No. 62/466,257.

Figure 5:
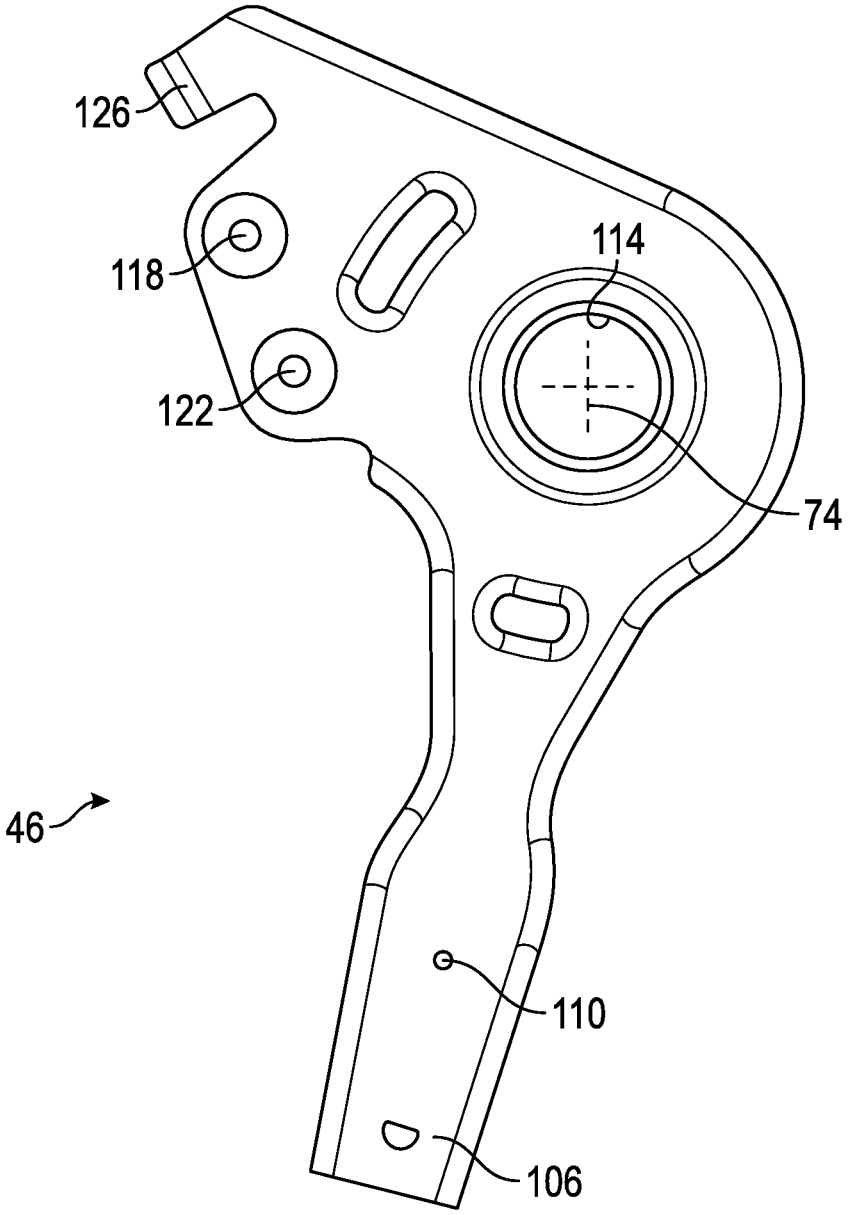
FIG. 5 is a top view of a speed control lever of the speed control system of FIG. 4.

As shown in FIG. 5, the speed control lever 46 includes a handle 106, a control lever remote aperture 110 defined in the handle 106 and sized to receive a wire actuator, a mounting aperture 114 sized to mount the speed control lever 46 to the bracket 70 about the first axis 74, a control lever speed aperture 118 sized to receive the control link 82, a control lever transport aperture 122 sized to receive the transport link 98, and a speed control cam surface 126 sized to interact with the ground switch 102 and actuate the ground switch between an off position where operation of the engine 30 is inhibited and an on position where operation of the engine 30 is allowed.

Figure 6:
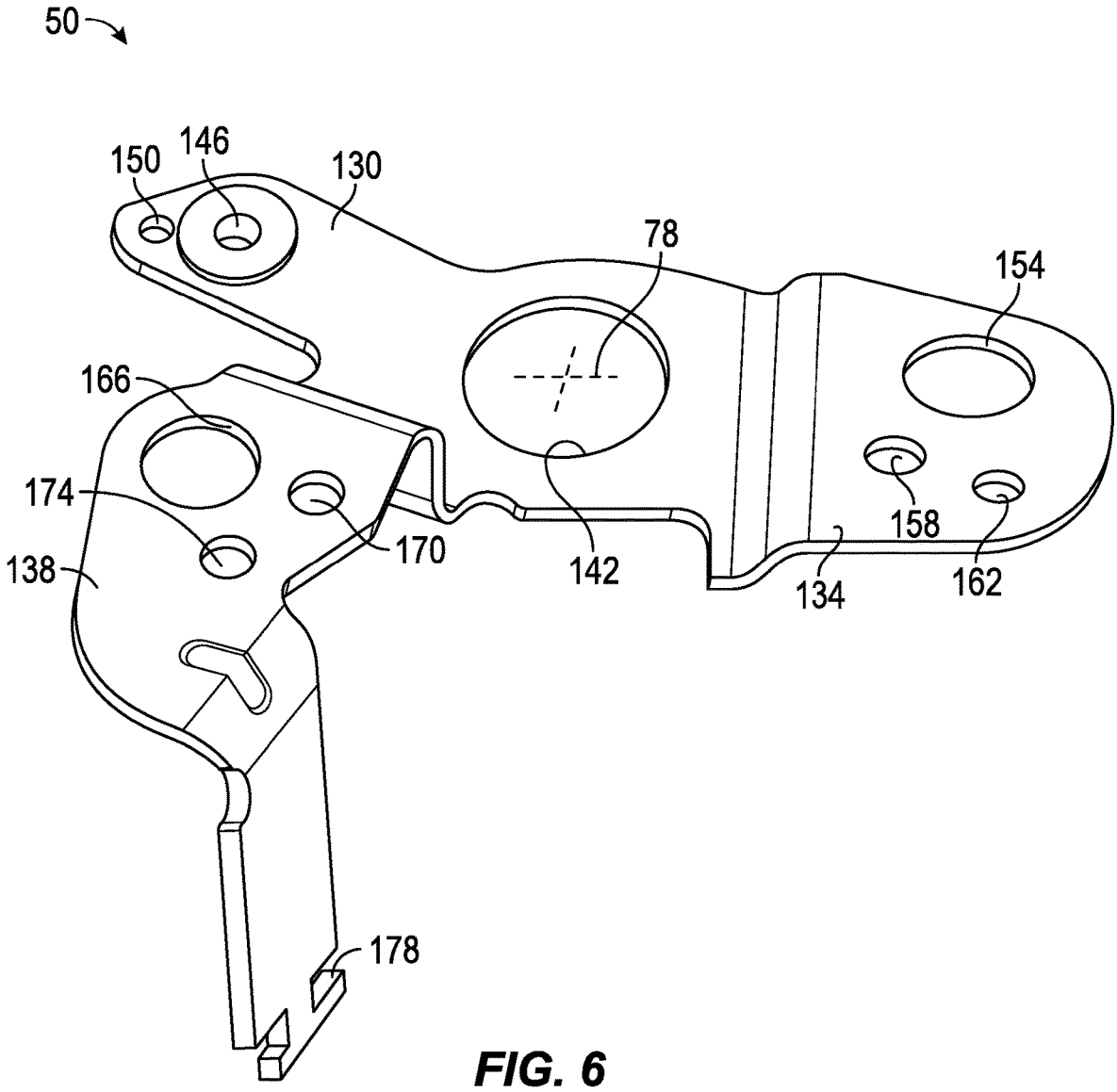
FIG. 6 is a pictorial view of a bellcrank of the speed control system of FIG. 4.

As shown in FIG. 6, the bellcrank 50 includes first arm 130, a second arm 134, a third arm 138, and a mounting aperture 142 sized to mount the bellcrank 50 to the bracket 70 about the second axis 78. The first arm 130 includes a bellcrank control aperture 146 sized to receive the control link 82, and a spring aperture 150. The second arm 134 includes a first soft wire aperture 154, a first short throw aperture 158, and a first long throw aperture 162. The third arm 138 includes a second soft wire aperture 166, a second short throw aperture 170, a second long throw aperture 174, and a governor spring holder 178 sized to engage and retain the governor spring 90. In some embodiments, the governor spring holder 178 is an aperture, a compression nut, or another coupling structure. In some embodiments, more than two, or less than two throw apertures may be included on each of the second arm 134 and the third arm 138. In some embodiments, the first throw apertures 158, 162 or the second throw apertures 170, 174 may be eliminated. In some embodiments, one or both of the soft wire apertures 154, 166 may be eliminated. In some embodiments, the spring aperture 150 may be eliminated.

Figure 7:
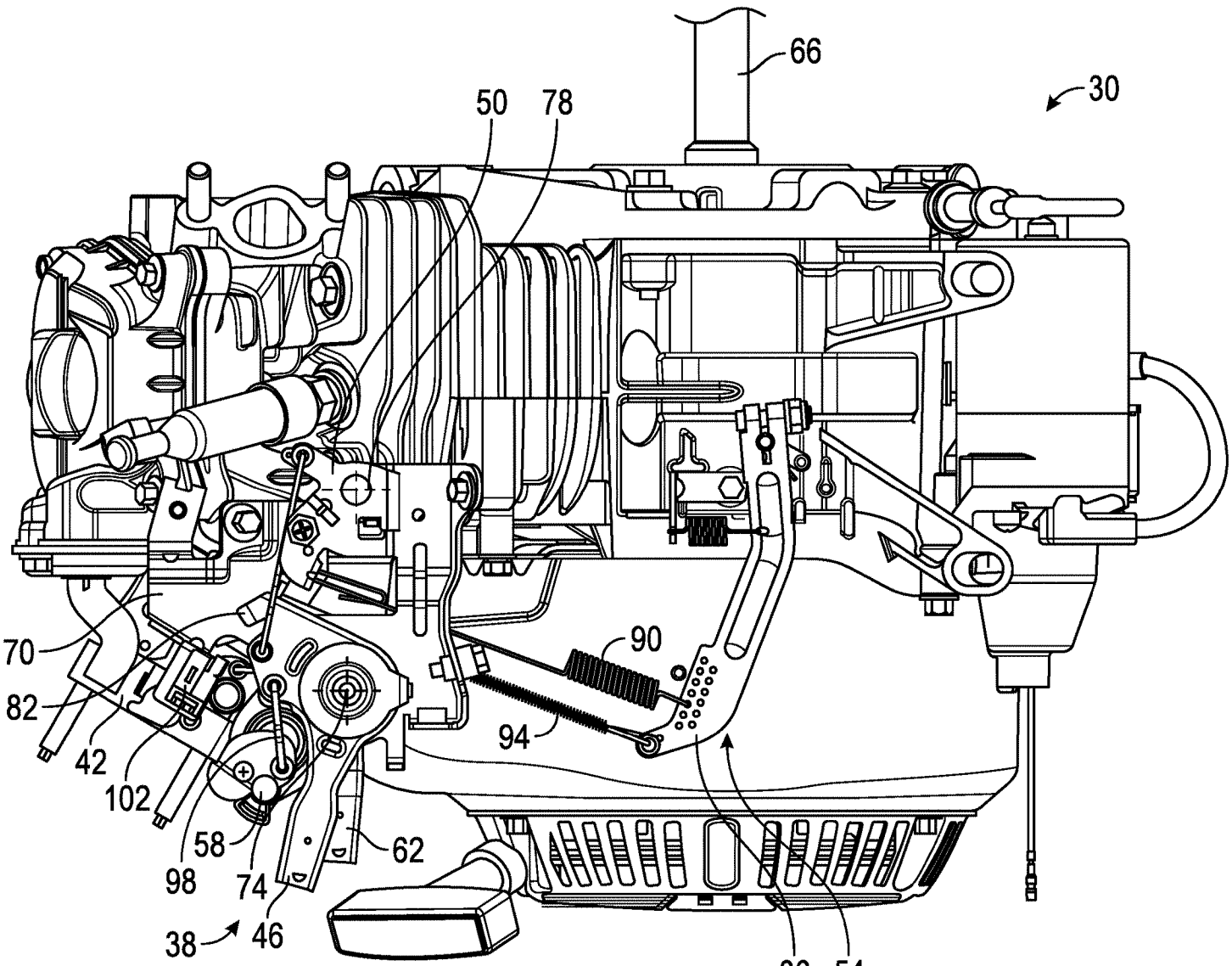
FIG. 7 is a top view of the engine of FIG. 1 showing the speed control system in a high speed arrangement.

As shown in FIG. 7, when the speed control lever 46 is positioned in a HSNL arrangement, the control link 82 pushes on the first arm 130 of the bellcrank 50 so that the bellcrank is rotated about the second axis 78 in a clockwise direction. The rotation of the bellcrank 50 results in the governor spring holder 178 pulling the governor spring 90 and increasing the tension applied to the governor arm 86. The increased tension urges the governor system 54 to increase the speed of the engine 30. In the HSNL arrangement, the speed control cam surface 126 does not contact the ground switch 102, and the engine 30 is permitted to operate or run. Additionally, the transport link 98 actuates the transport valve system 58 such that fuel is provided from the fuel tank 34 to the carburetor 42.

Figure 8:
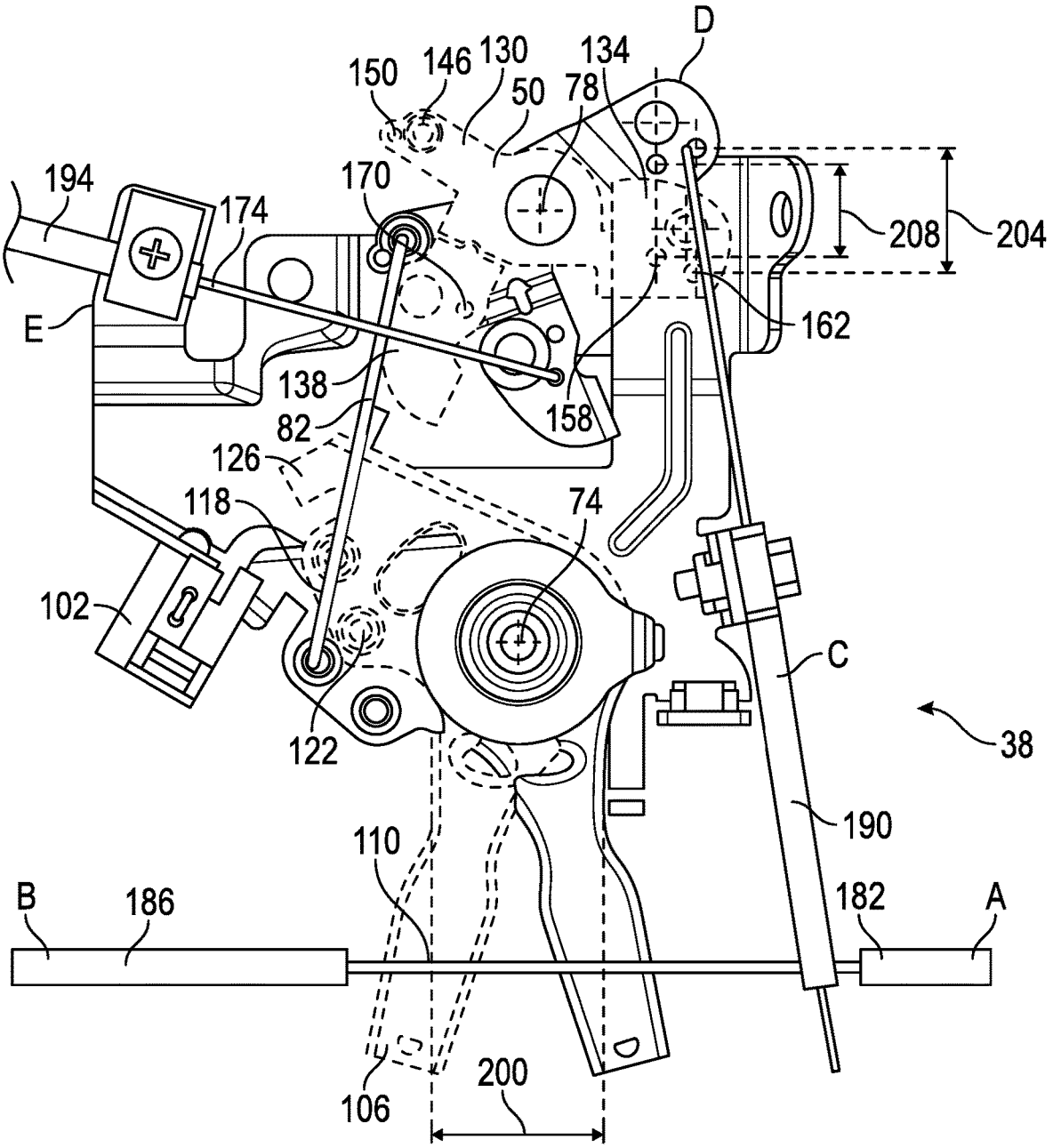
FIG. 8 is a top view of the speed control system of FIG. 4 in a variable speed control mode and solid wire or Bowden cable actuation.

As shown in FIG. 8, the speed control system 38 can be arranged to work with a first solid wire actuator 182 connected to the control lever remote aperture 110. The first solid wire actuator 182 is arranged to push the speed control lever 46 in the right lever direction A to the HSNL arrangement (shown in dashed lines). The first solid wire actuator 182 is arranged to pull the speed control lever 46 into an off position (shown in solid lines). The speed control system 38 can also be arranged to work with a second solid wire actuator 186 connected to the control lever remote aperture 110. The second solid wire actuator 186 is arranged to pull the speed control lever 46 in the left lever direction B to the HSNL arrangement and to push the speed control lever 46 to the off position. The speed control system 38 can also be arranged to work with a third solid wire actuator 190 connected to one of the first throw apertures 158, 162. The third solid wire actuator 190 is arranged to pull the second arm 134 of the bellcrank 50 in the front bellcrank direction C to the HSNL arrangement and to push the second arm 134 of the bellcrank 50 in the back bellcrank direction D to the off position. The speed control system 38 can also be arranged to work with a fourth solid wire actuator 194 connected to one of the second throw apertures 170, 174. The fourth solid wire actuator 194 is arranged to pull the third arm 138 of the bellcrank 50 in the left bellcrank direction E to the HSNL arrangement and to push the third arm 138 of the bellcrank 50 to the off position.

Figure 18:
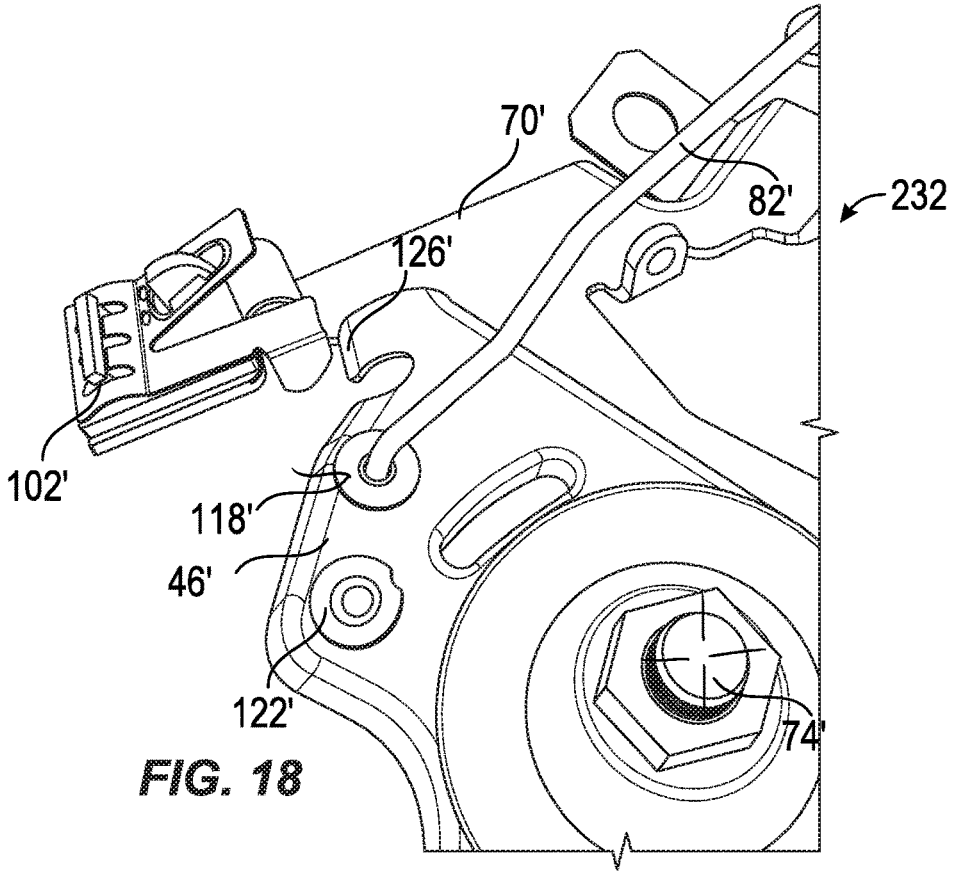
FIG. 18 is a pictorial view of the speed control system of FIG. 11 in a low speed arrangement between the off arrangement and the high speed arrangement.
Figure 19:
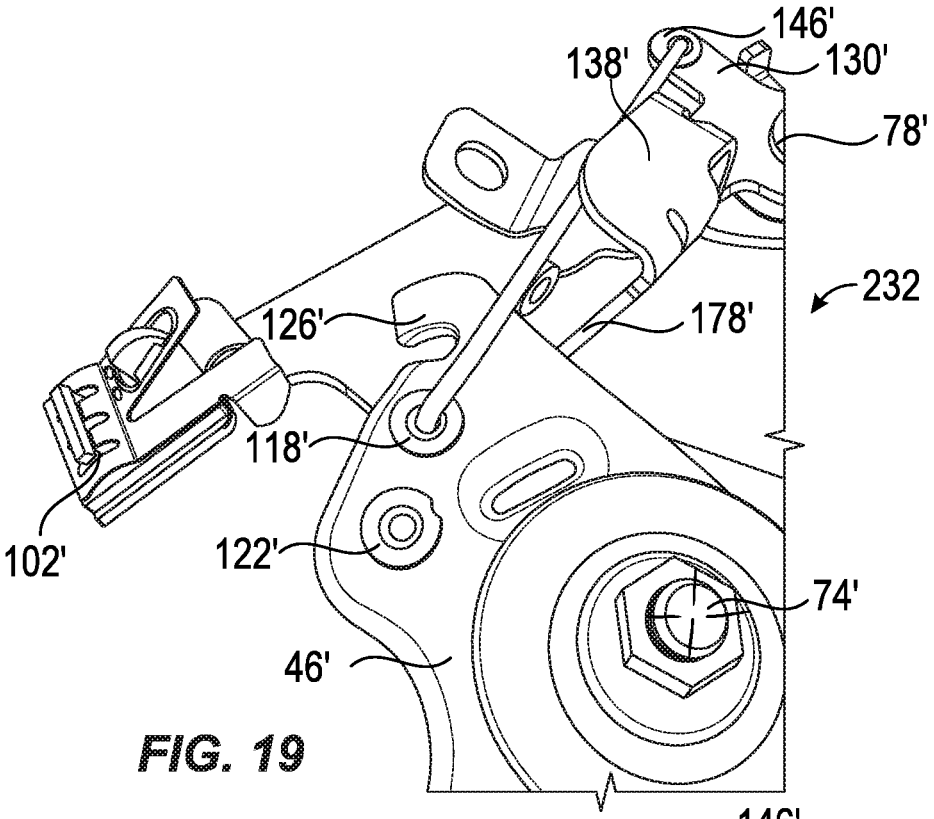
FIG. 19 is a pictorial view of the speed control system of FIG. 11 in the high speed arrangement.
Figure 20:
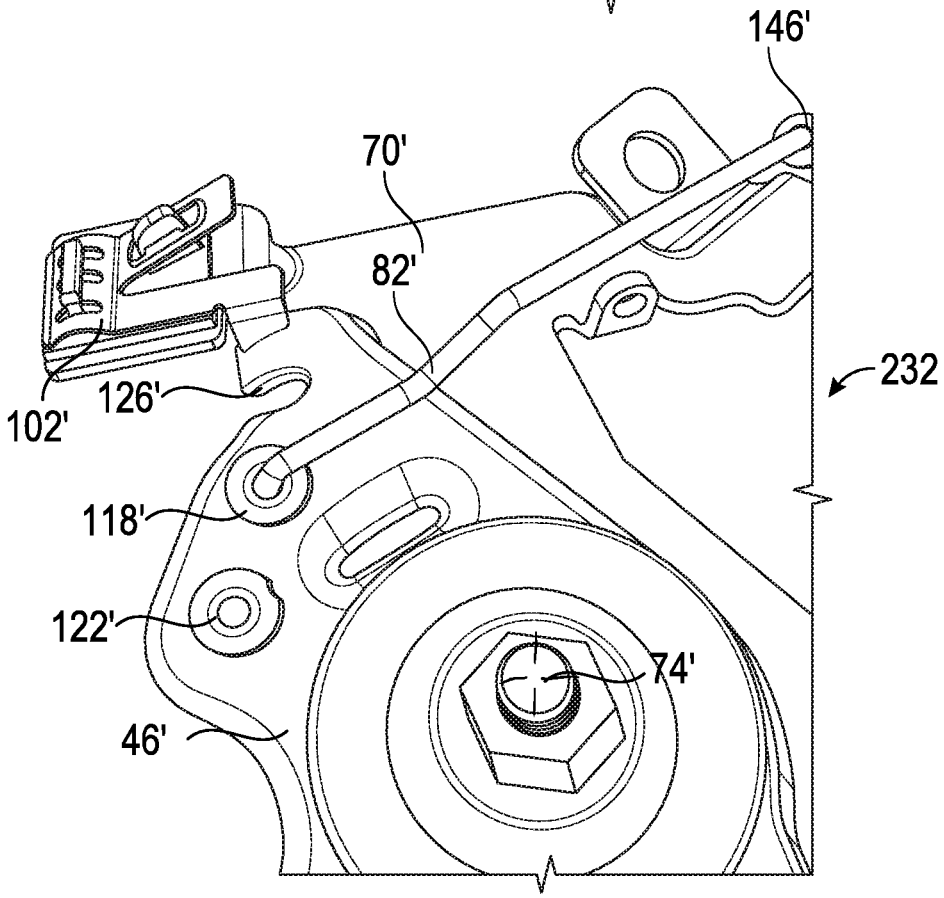
FIG. 20 is a pictorial view of the speed control system of FIG. 11 in the off arrangement.
Figure 21:
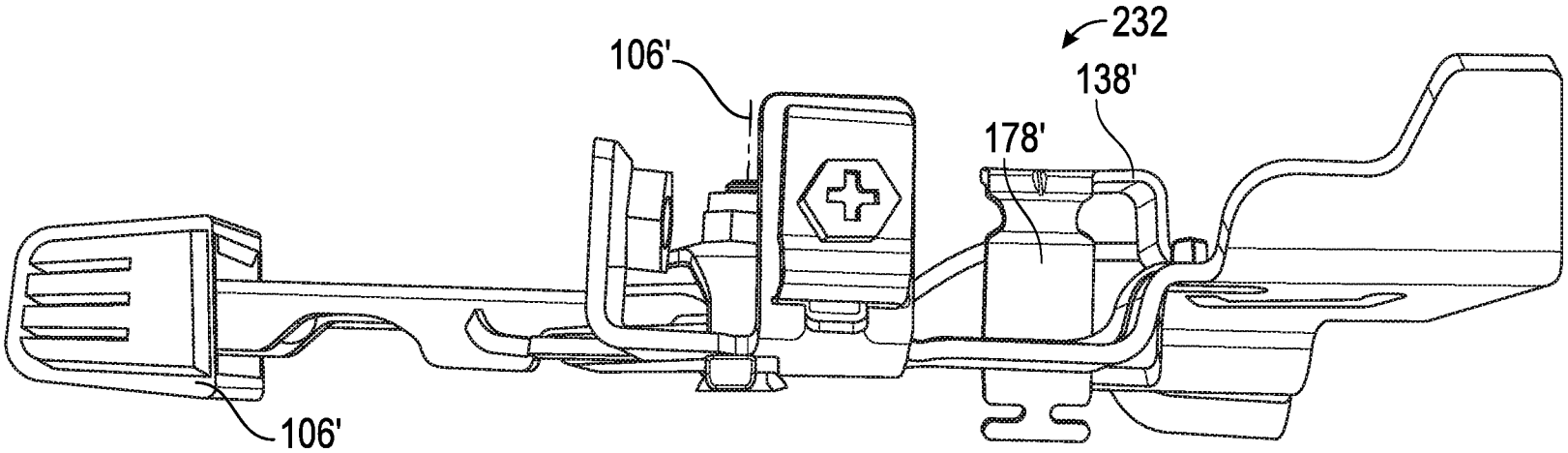
FIG. 21 is a pictorial view of the speed control system of FIG. 11 in the off arrangement.

The control link 82 connects the speed control lever 46 and the bellcrank 50 so that the movements of the speed control lever 46 and the bellcrank 50 are coordinated. The coordinated action of the speed control lever 46 and the bellcrank 50 results in actuation of the ground switch 102 and the transport valve system 58 via the actuators 182, 186, 190, 194 in addition to speed control, so that the speed control system 38 can be actuated between the HSNL arrangement, a low speed no load (LSNL) arrangement (see FIG. 18), and the off position (i.e., an ignition and fuel shutoff position).

In one embodiment, the control lever remote aperture 110 defines a first actuation distance 200 that is about 27.7 millimeters. In other embodiments, the first actuation distance can be more or less than 27.7 millimeters. The first long throw aperture 162 defines a second actuation distance 204 that is less than the first actuation distance and can be about twenty millimeters (20 mm). In other embodiments, the second actuation distance can be more or less than 20 mm. The first short throw aperture 158 defines a third actuation distance 208 that is less than the second actuation distance 204 and can be about fifteen millimeters (15 mm). In other embodiments, the first actuation distance can be more or less than 15 mm. The second long throw aperture 174 is also arranged to define the second actuation distance 204, and the second short throw aperture 170 is arranged to define the third actuation distance 208. The first actuation distance 200, the second actuation distance 204, and the third actuation distance 208 in addition to the ability of the speed control system 38 to operate using five different directions A-E allows the speed control system 38 to be incorporated into a wide variety of systems. For example, the engine 30 may be installed as a retrofit into a system originally designed to operate with a different engine type or manufacturer.

Figure 9:
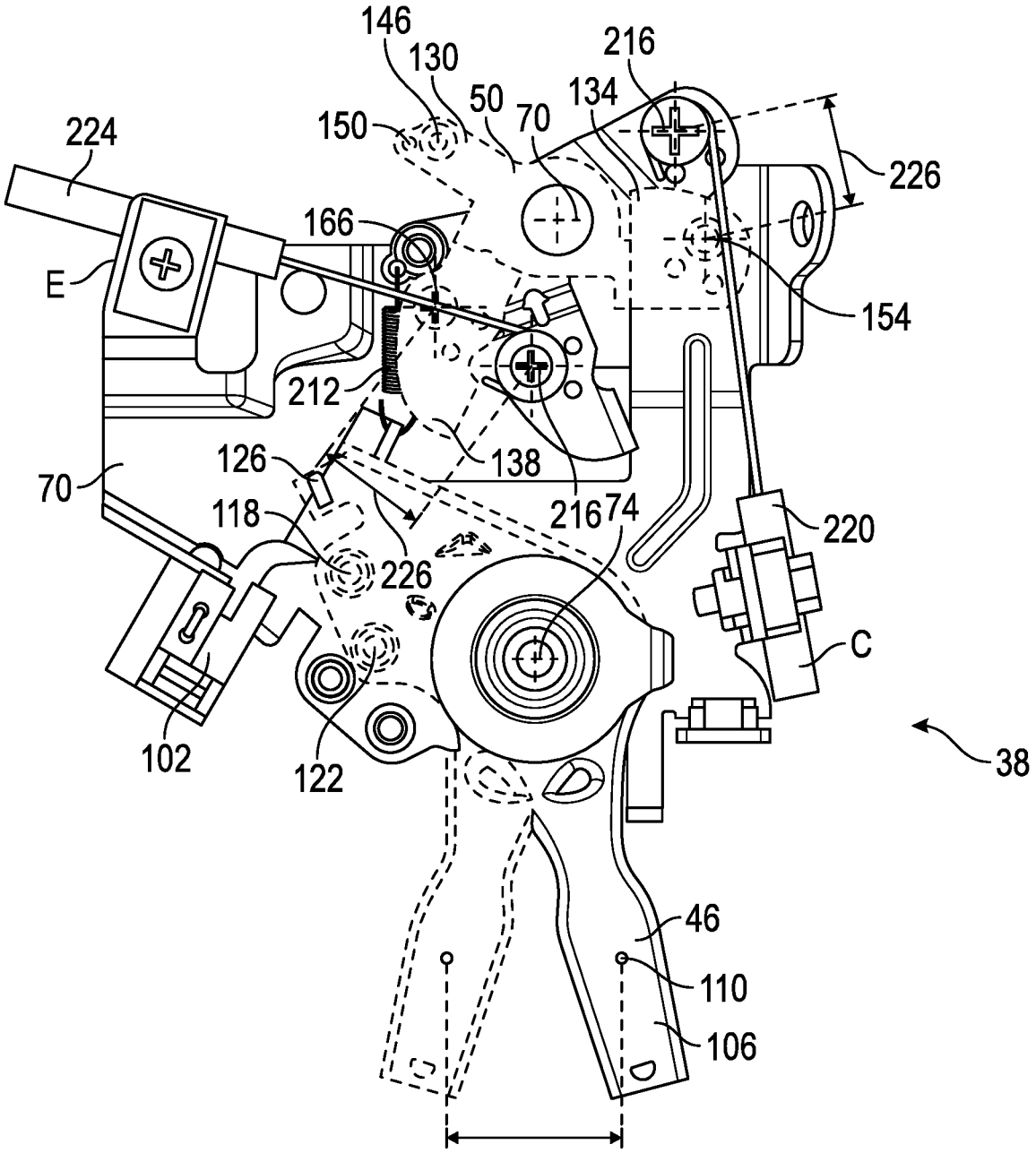
FIG. 9 is a top view of the speed control system of FIG. 4 in the variable speed mode and soft wire or braided wire actuation.

As shown in FIG. 9, the speed control system 38 can be arranged in a remote controlled speed and manually controlled ignition and fuel shutoff mode. The control link 82 is removed so that the speed control lever 46 and the bellcrank 50 operate independently. The speed control lever 46 is manipulated manually by a user between an on position and an off position. In the on position, the transport valve system 58 is actuated so that fuel is provided to the carburetor 42 and the speed control cam surface 126 does not engage the ground switch 102 so that the engine 30 can operate. In the off position, the transport valve system 58 is actuated so that fuel is inhibited from flowing to the carburetor 42 and the speed control cam surface 126 engages the ground switch 102 so that the engine 30 is inhibited from operating. In other embodiments, the first solid wire actuator 182 or the second solid wire actuator 186 may be installed and control the speed control lever 46.

A return spring 212 is attached between the spring aperture 150 on the first arm 130 and bracket 70 so that the bellcrank 50 is biased toward the idle position (shown in blue). The bellcrank 50 can be connected to either of the third solid wire actuator 190 or the fourth solid wire actuator 194 as discussed above to control engine speed. Alternatively, a soft wire holder 216 can be connected to either the first soft wire aperture 154 or the second soft wire aperture 166. The bellcrank 50 can be actuated by a first soft wire actuator 220 connected to the soft wire holder 216 installed in the first soft wire aperture 154. The first soft wire actuator 220 can pull the second arm 134 of the bellcrank 50 in the front bellcrank direction C to achieve the HSNL arrangement. The bellcrank 50 can also be actuated by a second soft wire actuator 224 connected to the soft wire holder 216 installed in the second soft wire aperture 166. The second soft wire actuator 224 can pull the third arm 138 of the bellcrank 50 in the left bellcrank direction E to achieve the HSNL arrangement. The return spring 212 moves the bellcrank 50 back into the idle position. In the illustrated embodiment, the first soft wire aperture 154 and the second soft wire aperture 166 define a fourth actuation distance 226 that is less than the second actuation distance 204 and larger than the third actuation distance 208. In one embodiment, the fourth actuation distance is about 17.5 millimeters. In other embodiments, the fourth actuation distance can be more or less than 17.5 millimeters.

Figure 10:
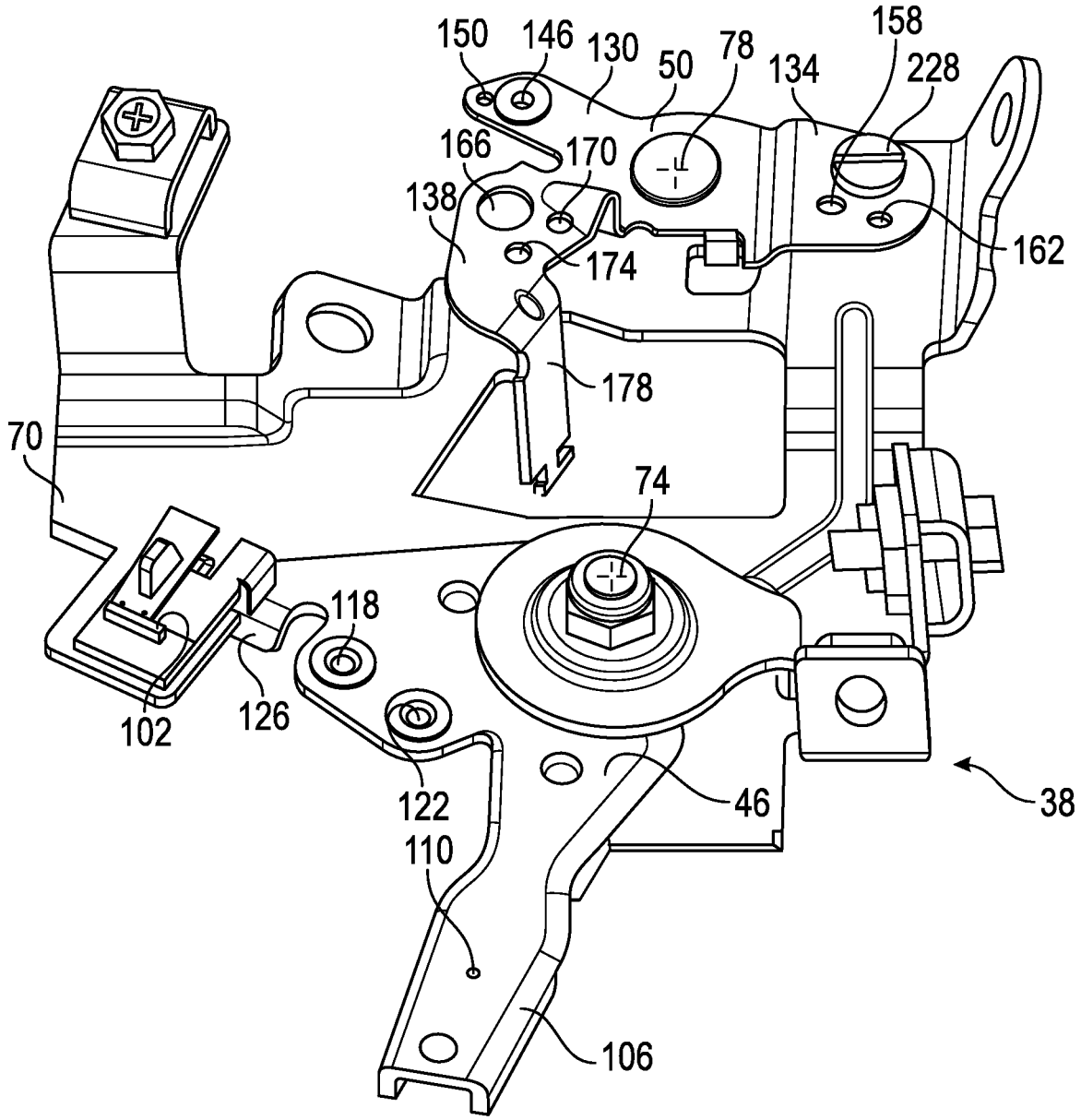
FIG. 10 is a pictorial view of the speed control system of FIG. 4 is a fixed speed mode.
Figure 11:
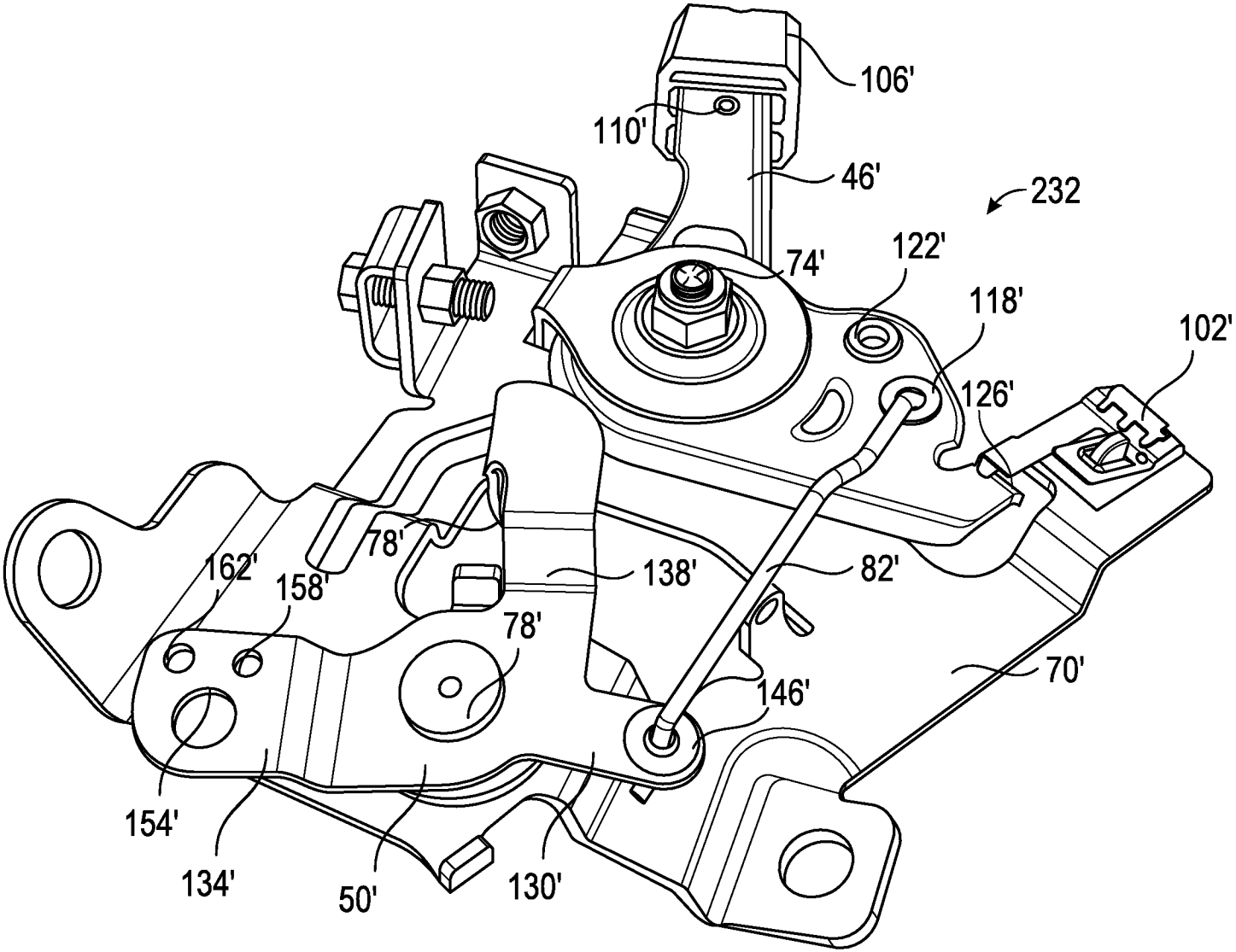
FIG. 11 is a pictorial view of another speed control system in an off arrangement, according to one embodiment.
Figure 12:
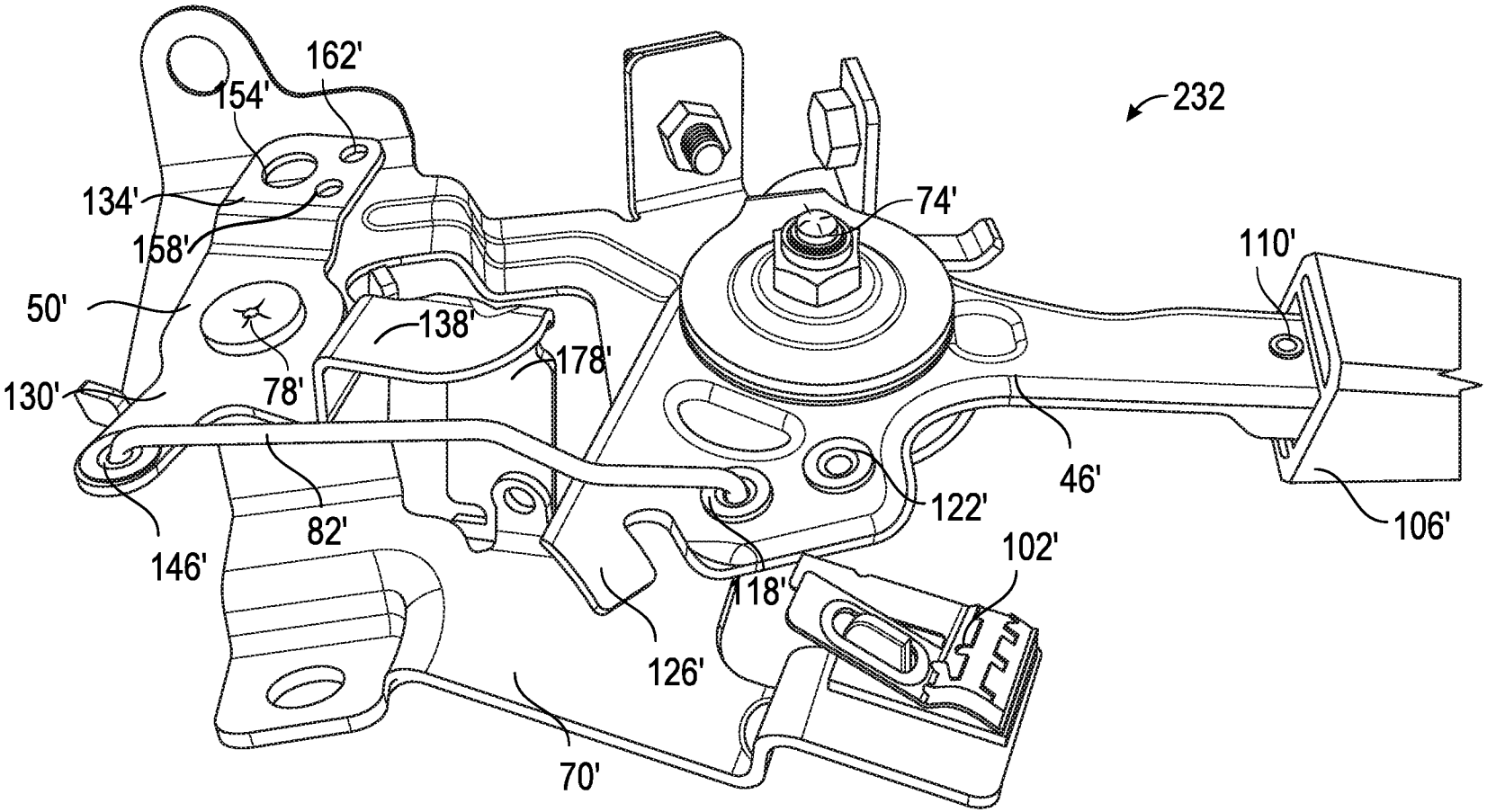
FIG. 12 is a pictorial view of the speed control system of FIG. 11 in a high speed arrangement.
Figure 13:
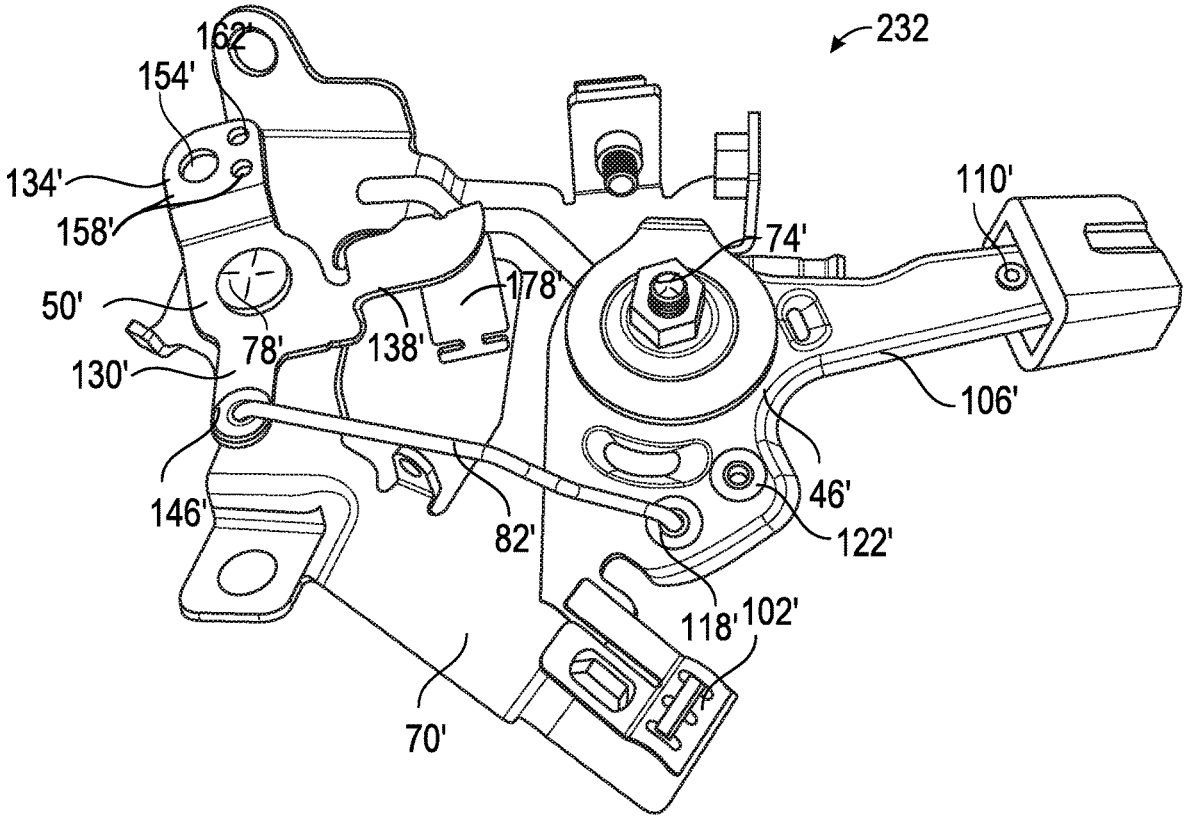
FIG. 13 is a pictorial view of the speed control system of FIG. 11 in the off arrangement.
Figure 14:
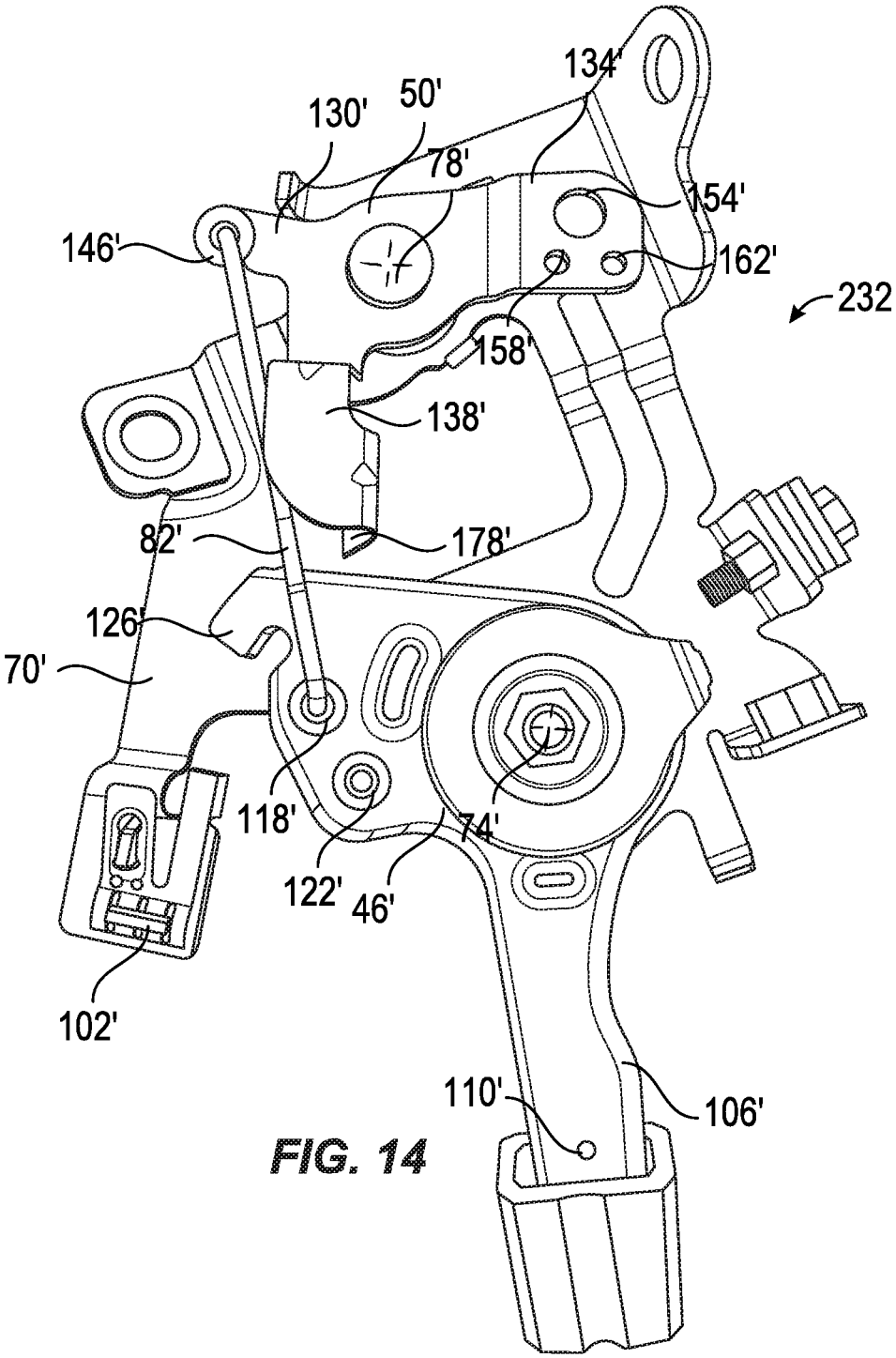
FIG. 14 is a pictorial view of the speed control system of FIG. 11 in the high speed arrangement.
Figure 15:
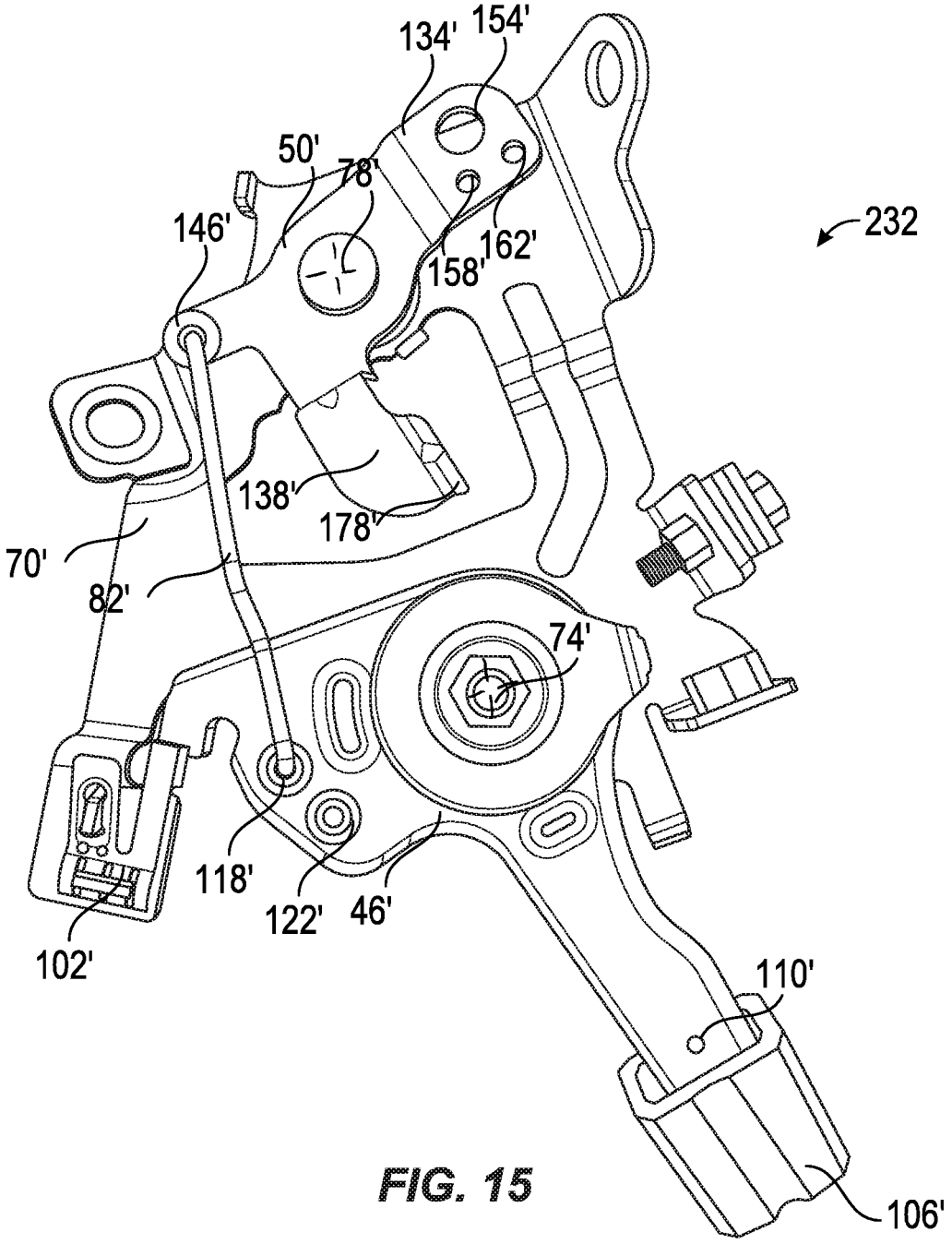
FIG. 15 is a pictorial view of the speed control system of FIG. 11 in the off arrangement.
Figure 16:
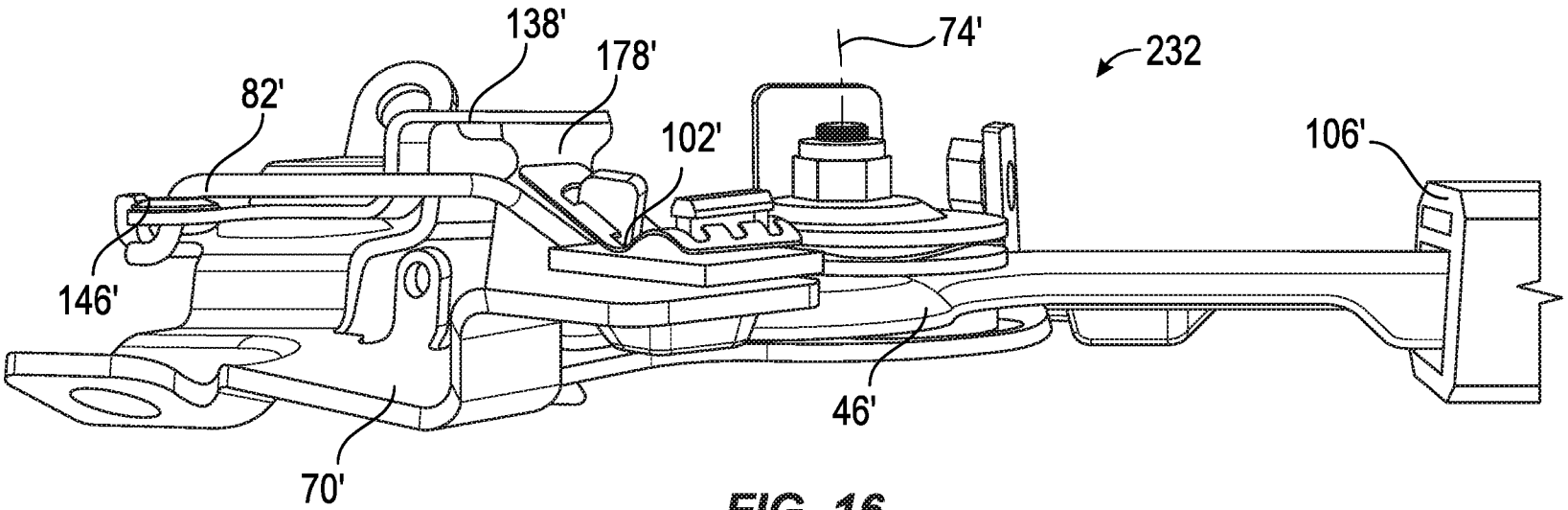
FIG. 16 is a pictorial view of the speed control system of FIG. 11 in the off arrangement.
Figure 17:
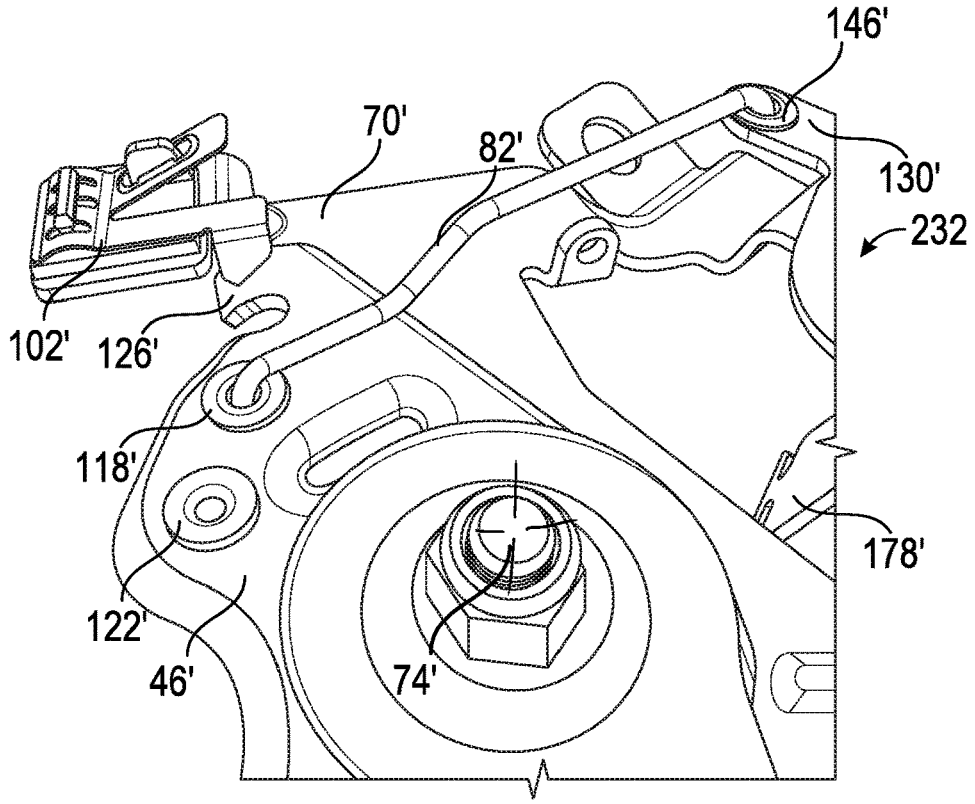
FIG. 17 is a pictorial view of the speed control system of FIG. 11 in the off arrangement.

As shown in FIG. 10, the speed control system 38 can be arranged in a fixed speed control arrangement. With the bellcrank 50 arranged in the HSNL position, a securing element or fastener in the form of shoulder screw 228 is secured through the first soft wire aperture 154 and into the bracket 70 so that the bellcrank 50 is fixed in place relative to the bracket 70. The control link 82 is removed so that the speed control lever 46 can be manipulated either manually or with the first or second solid wire actuators 182, 186 to provide ignition and fuel shutoff.

FIGS. 11-21 show another speed control system 232 that is similar to the speed control system 38 discussed above. Components of the speed control system 232 similar to those of the speed control system 38 are identified with the same reference numeral with the addition of a prime symbol.

Figure 22:
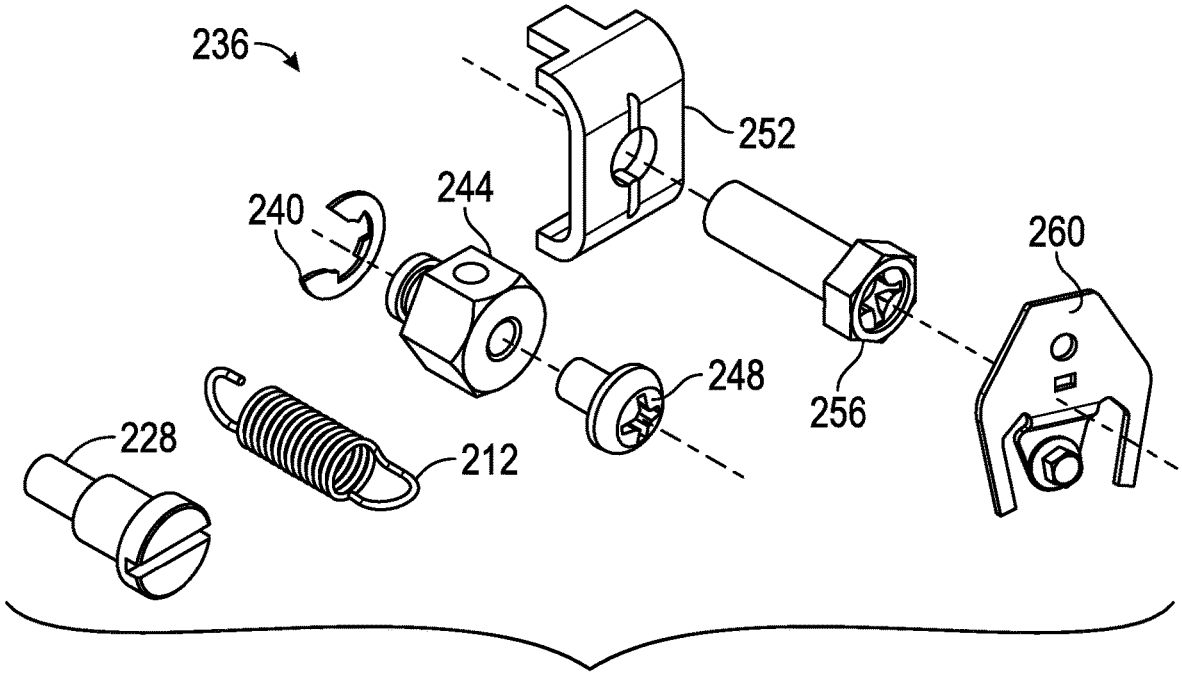
FIG. 22 is an exploded view of a connection kit arranged to be used with the speed control system of FIG. 4, according to one embodiment.

As shown in FIG. 22, a loose kit 236 can be provided with the engine 30 and includes the shoulder screw 228; the return spring 212; the soft wire holder 216 including a clip 240, a retainer nut 244, and a screw 248; a casing clamp 252 and a screw 256 for securing actuators; and a mounting bracket 260 that can be used to mount the first solid wire actuator 182.

Figure 23:
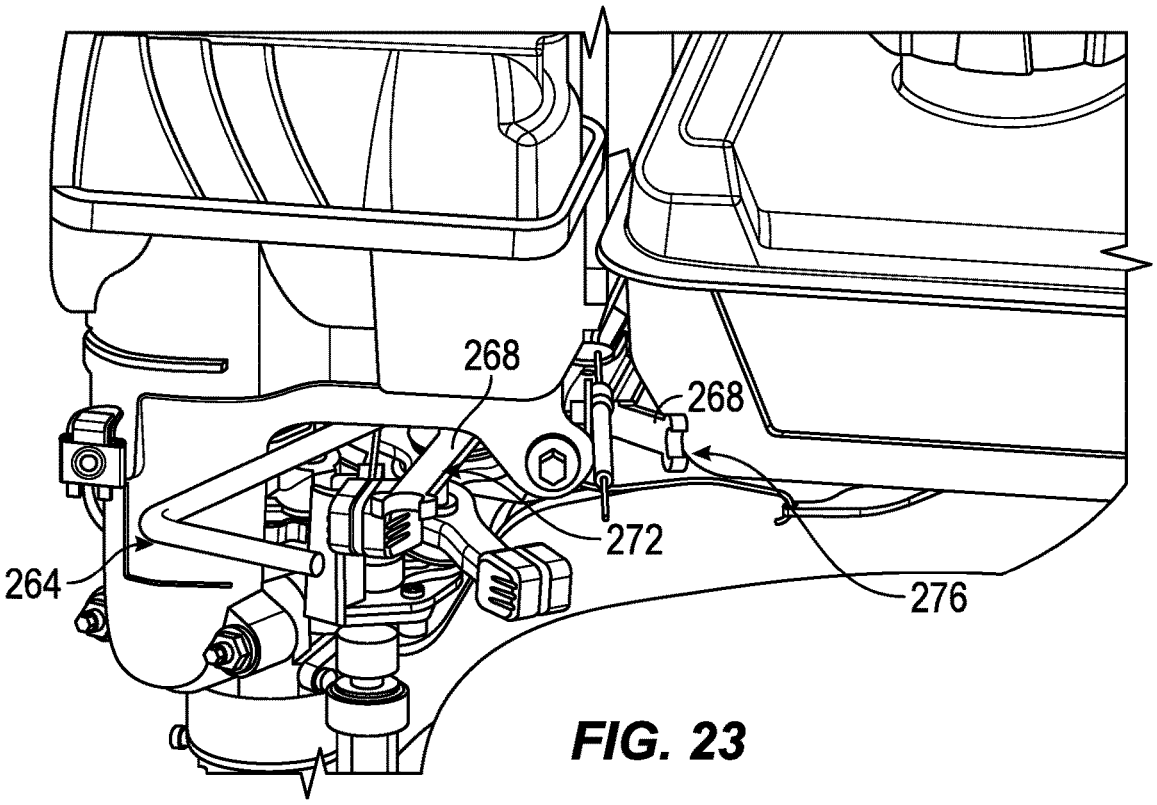
FIG. 23 is a pictorial view of the engine of FIG. 1 showing adjustment operations.

As shown in FIG. 23, the engine 30 provides a number of access points for adjusting the speed control system 38. A high speed tang bender 264 can be used to adjust the governor spring holder 178. A wrench 268 can be used to adjust the speed control lever 46 as shown at 272 or to install a remote actuator at 276.

Figure 24:
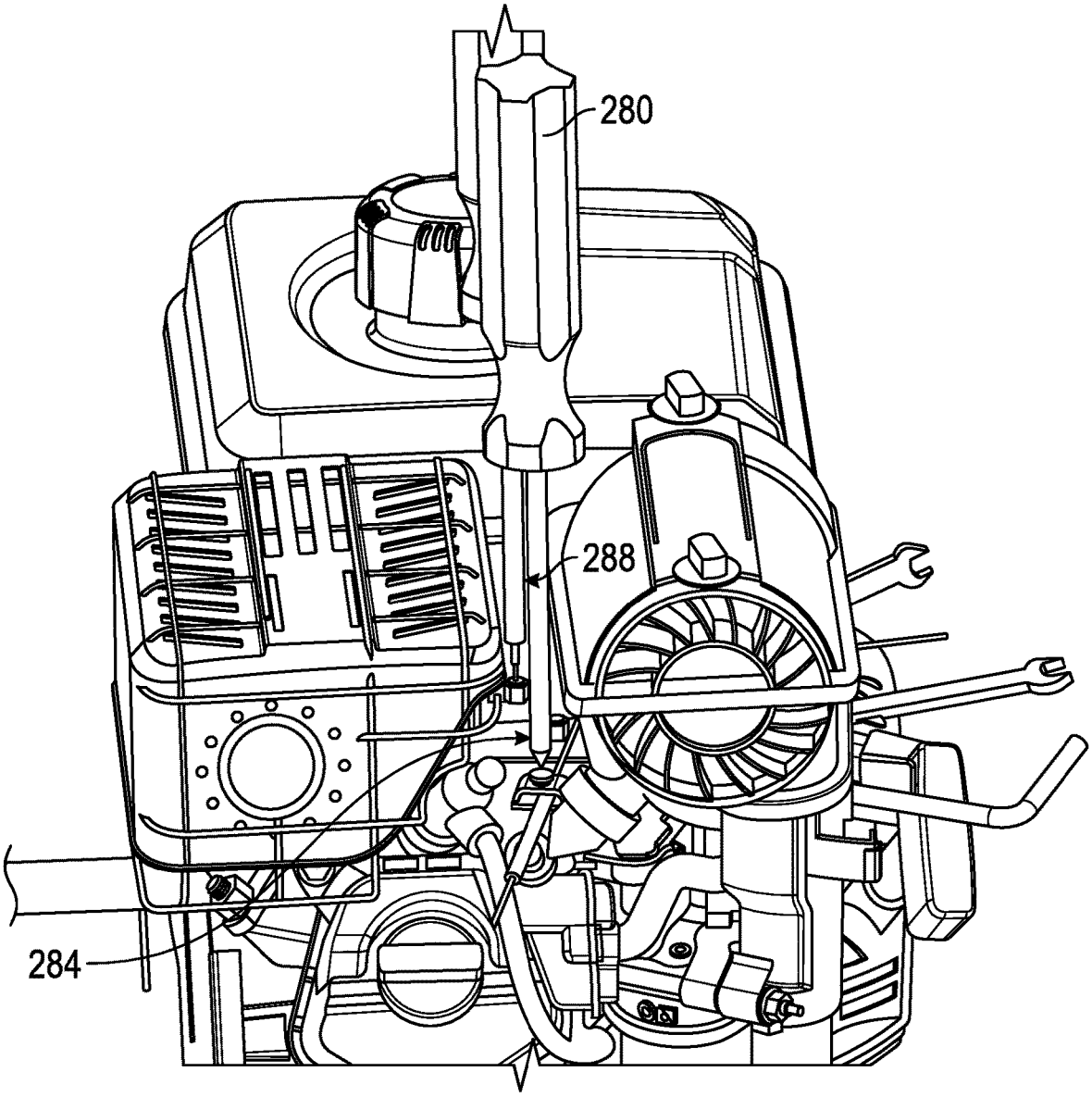
FIG. 24 is a pictorial view of the engine of FIG. 1 showing additional adjustment operations.

As shown in FIG. 24, a driver 280 can be used to install an actuator or install/adjust the soft wire holder 216.

The construction and arrangements of the engine speed control system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. An engine comprising:

a fuel tank;

a carburetor including a throttle valve movable between a first throttle position and a second throttle position;

a governor system configured to move the throttle valve; and a speed control system including a control lever movable between a first position and a second position, and defining a control lever coupling structure that defines a first actuation distance, and a bellcrank movable between an idle position and a high speed position, and defining a first bellcrank coupling structure and a second bellcrank coupling structure that defines a second actuation distance that is different than the first actuation distance, the bellcrank coupled to the governor system, wherein the speed control system is structured to be controlled by a remote actuator configured to engage one of the control lever coupling structure, the first bellcrank coupling structure, or the second bellcrank coupling structure to move the control lever and the bellcrank, and wherein the engine is structured to support the remote actuator to provide control from a first lever direction when the remote actuator engages the control lever coupling structure, a second lever direction opposed to the first lever direction when the remote actuator engages the control lever coupling structure, a first bellcrank direction when the remote actuator engages the first bellcrank coupling structure, a second bellcrank direction opposed to the first bellcrank direction when the remote actuator engages the first bellcrank coupling structure, and a third bellcrank direction different than the first bellcrank direction and the second bellcrank direction when the remote actuator engages the second bellcrank coupling structure.

2. The engine of claim 1, wherein the first actuation distance is about 27.7 millimeters, and the second actuation distance is selected from one of 15 millimeters, 17.5 millimeters, and 20 millimeters.

3. The engine of claim 1, wherein the control lever coupling structure includes an aperture sized to receive a solid wire actuator of the remote actuator.

4. The engine of claim 1, wherein the first bellcrank coupling structure includes an aperture configured to engage one of a solid wire actuator and a soft wire actuator of the remote actuator.

5. The engine of claim 1, wherein the bellcrank is coupled to the control lever via a control link so that moving the control lever between the first position and the second position moves the bellcrank between the idle position and the high speed position.

6. The engine of claim 1, wherein the control lever and the bellcrank are coupled to a bracket.

7. The engine of claim 6, wherein the bellcrank can be fixed to the bracket so that the bellcrank is inhibited from moving relative to the bracket.

8. The engine of claim 1, further comprising an electrical shutoff element positioned to be actuated by the control lever.

9. The engine of claim 8, wherein the electrical shutoff element includes an ignition ground switch.

10. The engine of claim 8, wherein the control lever is grounded to the engine, and wherein the electrical shutoff element is an ignition ground wire configured to ground an ignition circuit when it contacts the control lever.

11. The engine of claim 1, further comprising a transport valve fluidly coupled between the fuel tank and the carburetor, the transport valve including a valve element moveable between an open valve position allowing fuel flow between the fuel tank and the carburetor, and a closed valve position preventing fuel flow between the fuel tank and the carburetor, wherein the valve element is moveable in response to the control lever.

12. The engine of claim 1, wherein the control lever and the bellcrank operate independently so that the bellcrank affects engine speed and the control lever controls an ignition kill circuit and a fuel shutoff.

13. The engine of claim 1, wherein the speed control system can be arranged in a remote control mode, a manual control mode, or a fixed speed mode.

14. The engine of claim 1, wherein the speed control system includes a control link coupling the control lever to the bellcrank.

15. The engine of claim 1, wherein a position of the control lever is controlled by the bellcrank.

16. The engine of claim 1, wherein the control lever is moveable between a high speed position, a low speed position, and an off position.

17. The engine of claim 1, wherein the control lever controls an ignition kill circuit, a fuel shutoff, and affects engine speed.

18. The engine of claim 1, wherein the first bellcrank coupling structure further defines a third actuation distance that is less than the second actuation distance.

19. The engine of claim 18, wherein the second actuation distance is about twenty millimeters and the third actuation distance is about fifteen millimeters.

20. The engine of claim 19, wherein the bellcrank further defines a fourth actuation distance that is about 17.5 millimeters.

* * * * *